US012723386B2

(12) United States Patent
Machui et al.

(10) Patent No.: US 12,723,386 B2
(45) Date of Patent: Sep. 1, 2026

(54) WATER TAP AND METHOD FOR OPERATING THE WATER TAP

(71) Applicant: BRITA SE, Taunusstein (DE)

(72) Inventors: Oliver Machui, Bad Homburg (DE); Gregor Stiehl, Hünfelden (DE); Johann Heger, Frankfurt am Main (DE)

(73) Assignee: BRITA SE, Taunusstein (DE)

( * ) Notice: Subject to any disclaimer, the term of this patent is extended or adjusted under 35 U.S.C. 154(b) by 327 days.

(21) Appl. No.: 18/549,754

(22) PCT Filed: Mar. 8, 2022

(86) PCT No.: PCT/EP2022/055819
§ 371 (c)(1),
(2) Date: Sep. 8, 2023

(87) PCT Pub. No.: WO2022/189396
PCT Pub. Date: Sep. 15, 2022

(65) Prior Publication Data

US 2024/0309622 A1 Sep. 19, 2024

(30) Foreign Application Priority Data

Mar. 11, 2021 (EP) ..... 21162004

(51) Int. Cl.
*E03C 1/04* (2006.01)
*E03C 1/05* (2006.01)

(52) U.S. Cl.
CPC ..... *E03C 1/041* (2013.01); *E03C 1/055* (2013.01)

(58) Field of Classification Search
CPC ..... E03C 1/041; E03C 1/055; E03C 1/0411; E03C 1/044
See application file for complete search history.

(56) References Cited

U.S. PATENT DOCUMENTS

2015/0322651 A1* 11/2015 Gnauert ..... E03C 1/0412 4/676
2019/0264428 A1* 8/2019 Casey ..... E03C 1/057
(Continued)

FOREIGN PATENT DOCUMENTS

CN 110906043 A 3/2020
CN 111448356 A 7/2020
(Continued)

OTHER PUBLICATIONS

Chinese Examination Report dated Apr. 1, 2026 for corresponding CN 202280020125.3 application.

*Primary Examiner* — Christine J Skubinna
(74) *Attorney, Agent, or Firm* — Hudak, Shunk & Farine Co. LPA

(57) ABSTRACT

A method of operating a water tap, in particular a hot water tap, including a dispensing step in which water is dispensed from the water tap. Initiation of the dispensing step requires several preceding steps, including an actuation of a first actuating element and an actuation of a second actuating element. Within an actuation step, the actuation of a first actuating element is detected by a control unit. The actuation step also includes an unlocking step, in which, upon detection of the actuation of the first actuating element, an unlocking time window is started by the control unit. The actuation step also includes an activating step in which the actuation of the second actuating element activates a dispensing switch. The dispensing step is only initiated in case that the activating step is triggered within the unlocking time window.

13 Claims, 2 Drawing Sheets

(56) References Cited

U.S. PATENT DOCUMENTS

| | | | | |
|---|---|---|---|---|
| 2019/0376615 | A1* | 12/2019 | Becroft | E03C 1/041 |
| 2021/0140156 | A1* | 5/2021 | Rowe | E03C 1/0411 |

FOREIGN PATENT DOCUMENTS

| | | | |
|---|---|---|---|
| EP | 2754759 | A2 | 7/2014 |
| EP | 2841657 | B1 | 3/2015 |
| EP | 3766828 | A2 | 1/2021 |

* cited by examiner

WATER TAP AND METHOD FOR OPERATING THE WATER TAP

FIELD OF INVENTION

The invention relates to a method of operating a water tap, in particular a hot water tap, comprising a dispensing step in which water is dispensed from the water tap, wherein initiation of the dispensing step requires an actuation of a first actuating element and an actuation of a second actuating element, and wherein, in an actuation step, the actuation of the first actuating element is detected by a control unit.

The invention also relates to a system comprising a water tap.

BACKGROUND OF THE INVENTION

A conventional water tap comprises a valve that can be operated by a user by way of manually handling a single actuating element. The actuating element can be e.g. a knob that can be rotated or a lever that can be pushed or pivoted. However, if the water tap also allows for dispensing hot water, it is considered a good idea to provide for additional safety measures in order to avoid unintentional operation of the water tap and unintentional release of hot water, which could endanger the user or persons in the vicinity.

It is known from practice to add locking means to a single actuating element, whereby a user must first unlock the locking means before an actuation of the actuating element is possible. Such locking means can be e.g. a push button that must be pushed before a knob can be turned or before a lever can be moved. However, if the locking means are arranged at or within the actuating element, it might be possible to operate the locking means and the actuating element with one hand and possibly within the same motion, which reduces the safety of the handling of the water tap. If the locking means are arranged at a distance to the actuating element, the actuating of the water tap usually requires a coordinated handling of two hands, which reduces the handling comfort of the water tap.

It is also known to provide for two actuating elements that are connected to a control unit. The control unit is designed to detect an actuation of the actuating elements and to operate a valve or a pump to release water from the water tap if the actuation of the actuating elements meets a predefined criterion. Usually, both actuating elements must be actuated within a preset time span and the release of water is only possible if the control unit detects the actuation of both actuating elements within the time span. Some water taps also prevent any release of water if both actuating elements are actuated within a very short time span or actuated at the same time in order to enhance the safety aspect of the actuation of the water tap.

The control unit can contain a microchip and monitor and control the operation of the water tap through software. By controlling the water tap with a software application, it is possible to provide for a comfortable use of the water tap and to also provide for a high level of user safety. However, such a control unit and in particular the software are then regarded as safety-relevant component of the water tap, which leads to high safety requirements and thus to elaborate tests and certifications for the software that are required for manufacturing and marketing of such a water tap. A possible failure of the control unit may affect the safety of the water tap, which increases the required efforts to provide for a failure-proof control unit.

Accordingly, there is a need for a method of operating a water tap that allows for a comfortable actuation by a user and provides for a reliable and safe operation of the tap.

SUMMARY OF THE INVENTION

The present invention provides a method of operating a water tap, in particular a hot water tap, comprising: a dispensing step, in which water is dispensed from the water tap, wherein initiation of the dispensing step requires an actuation of a first actuating element and an actuation of a second actuating element, and wherein, in an actuation step, the actuation of the first actuating element is detected by a control unit, wherein the actuation step comprises an unlocking step in which, upon detection of the actuation of the first actuating element, an unlocking time window is started by the control unit, wherein the actuation step also comprises an activating step in which actuation of the second actuating element activates a dispensing switch, and wherein the dispensing step is only initiated in case that the activating step is triggered within the unlocking time window.

By separating the actuation step into two different steps, i.e. the unlocking step and the activating step, that must be performed independently of each other, but within a specified time period, a user-friendly and at the same time safe operation of the water tap can be provided at small costs. The first step, namely the unlocking step, involves the control unit. Contrary thereto, the second step, namely the activation step does not require the control unit, but a dispensing switch that is not part of the control unit. In case that there is a failure of the control unit, the dispensing switch still provides for a safe operation of the water tap. The dispensing switch may consist of hardware that is not controlled or operated by software. The dispensing switch may comprise a pushbutton switch or a rocker switch with which an electrical line can be opened or closed. Such pushbuttons or rocker switches can also form the second actuation element that must be handled and actuated by a user. The dispensing switch can also be formed by electronic components or semiconductors without involving mechanically operating and moving components.

In an embodiment, an electric line is part of a power supply of an electric pump or an electric valve for dispensing water through the tap, and closure of the electric line by activating the dispensing switch through actuation of the second actuating element is mandatory to operate the pump or valve and performed in the activating step without involving the control unit.

The actual operation of the pump or the valve can also require additional input from the control unit. It is also possible to enable and to disable the dispensing switch by the control unit. The meaning of dispensing switch is not limited to a conventional switch, but includes all devices including electronic components or microchips that can be actuated or triggered to switch between at least to different configurations or conditions or positions which will affect the outflow of water from the water tap.

It is considered a main aspect of the present invention that dispensing water from the water tap requires actuation of the first actuating element resulting in actuation of the control unit as well as actuation of the second actuating element resulting in a corresponding activation or deactivation of the dispensing switch. Due to the two different actuations that are required, a very high level of safety can be provided. The involvement of the control unit allows for adapting a user-friendly way of operation, whereas the mandatory use of an independently operated dispensing switch results in a high operational safety and reliability without directing the focus towards the software and the control unit.

It is possible that there is a mechanical lock that disables any operation of the dispensing switch, and that the mechanical lock is controlled and operated by the control unit. In order to increase the operational safety of the water tap and to also reduce the manufacturing costs, the actuation of the dispensing switch is performed without involving the control unit. Thus, the control unit does not mechanically or operatively interact with the second dispensing switch. It is always possible for a user to actuate the second actuating element and the dispensing switch. However, unless there is additional input from the control unit, the water tap will not dispense any water.

According to an embodiment of the invention, the activating step comprises forwarding an activating signal related to the activation of the dispensing switch to the control unit, and the actuation step comprises an initiation step in which the control unit initiates the dispensing step only after successful verification that the activating signal is received within the unlocking time window that was started by actuation of the first actuating element. By adding such a verification performed by the control unit, additional safety measures are included. Furthermore, receiving the activating signal that indicates the closed state of the dispensing switch may be used to trigger the control unit to e.g. activate a pump or switch a valve in order to initiate the dispensing step.

In yet another embodiment of the invention, the unlocking step also comprises the activation of a first, and the dispensing step is only initiated in case that the dispensing switch and the further dispensing switch are activated within the unlocking time window. Both the dispensing switches can be connected in series within a power supply of an electrical component like e.g. a pump or a valve that controls the outflow of water through the water tap. The electrical component will only be connected to a power source in case that both dispensing switches are activated. Thus, there is no need to generate an activation signal and to forward such a signal to the control unit. After activating the further dispensing switch, also referred to herein as the first dispensing switch, the control unit monitors the unlocking time window and deactivates the first dispensing switch after expiration of the unlocking time window unless there is no activation of the other dispensing switch within the unlocking time window. If the activation of the other dispensing switch occurs within the unlocking time window, the unlocking time window is terminated without deactivating the first dispensing switch, which will allow a user to continue with dispensing water from the water tap.

The duration of the outflow of water through the water tap can be controlled by the second actuating element. As long as a user actuates the second actuating element, the dispensing switch remains closed and water will be dispensed from the water tap. It is also possible to limit the duration of the dispensing step and the outflow of water e.g. to a preset dispensing time window which can be monitored and managed by the control unit. Thus, a short touch or contact of the second actuating element can e.g. trigger the outflow of water for 5 seconds, whereas a long touch or contact of the second actuating element results in dispensing water as long as the long touch or contact is detected.

In an embodiment of the invention, the actuation of the second actuating element actuates a timer element that deactivates the dispensing switch after expiration of a preset time limit of the timer element. Such a timer limits the maximum duration of dispensing water from the water tap and prevents excessive discharge of water, in particular of hot water from the water tap. The timer element may operate without any involvement of the control unit, which adds to the safety of operation of the water tap. The timer element can manipulate the dispensing switch in a manner as to deactivate the dispensing switch and e.g. to interrupt an electrical current that results in stopping the water flow from the water tap.

According to yet another embodiment of the invention, the control unit starts a timer upon detection of the actuation of the first actuating element or upon starting of the unlocking time window, and the control unit stops the dispensing step and further dispensing of water from the water tap after expiration of a preset time limit of the timer. Thus, also the control unit is able to monitor and control the duration of an outlet of water with the water tap. Even in case that the timer element that is operatively connected to the second actuating element does not work properly, the control unit is able to limit the maximum amount of water that is dispensed after both of the actuating elements have been actuated in a proper manner to start dispensing of water from the water tap. The timer started upon detection of the actuation of the first actuating element or upon starting of the unlocking time window can also be used to only monitor the unlocking time window.

In an embodiment of the invention, the control unit initiates the dispensing step and stops the dispensing step by activating and deactivating a further dispensing switch that is in operative connection with the dispensing switch in such a manner that dispensing water from the water tap requires the dispensing switch and the further dispensing switch to be activated. Adding a further dispensing switch that controls the dispensing of water adds additional safety to the operation of the water tap at low manufacturing costs. Such a further dispensing switch can be a simple and inexpensive device that can be integrated into the water tap without a noticeable increase in manufacturing costs. Furthermore, making use of a further dispensing switch that can be identical or similar to the other dispensing switch provides additional operational safety at low costs for manufacturing or maintenance of the water tap. The further dispensing switch can be connected in series into an electrical line that activates or deactivates a pump or a valve that starts or stops dispensing water from the water tap.

According to an embodiment of the invention, by activating the dispensing switch and the further dispensing switch a pump or a valve is activated that dispenses water through the water tap. Both the dispensing switch and the further dispensing switch may be arranged in series within an electrical line that controls or provides for power supply of an electrical device that is used for controlling the outflow of water through the water tap, e.g. a pump or a valve.

Even though the dispensing switch is activated without any involvement of the control unit, the current status of the dispensing switch as well as a current status of the timer element actuated by the second actuating element can be monitored by the control unit or can be forwarded by corresponding signals or digital information towards the control unit. This enables the control unit to affect the operation of the water tap on the basis of information from all components that are involved for dispensing water from the water tap.

The invention also relates to system comprising a water tap as defined in claim 10.

Water taps with two actuating elements that are operatively connected to a control unit are known from prior art. However, the control unit of these water taps is regarded as a main component for providing operational safety. Thus, the software of the control unit is regarded as an essential component and part of the operational safety of the water tap, resulting in high demands on operational safety focusing on the software and the corresponding control unit. These demands increase the manufacturing costs and the efforts required for testing and certifying the software that is used for operating the control unit.

Thus, there is a need for a water tap that allows for a comfortable actuation by a user and provides for a reliable and safe operation of the tap.

Accordingly, the present invention also relates to such a water tap. The second actuating element is operatively connected to a dispensing switch. The second actuating element may be further configured to transmit an activating signal to the control unit. The system, for example the control unit, is configured to initiate a dispensing step in which water is dispensed from the water tap only after successful verification that the activating signal from the second actuating element is received within an unlocking time window that was started by actuation of the first actuating element. The water tap may be provided with the operating means comprising the first actuating element, the second actuating element and the control unit.

By making use of two actuating elements, a very comfortable and intuitive manner of activating the water tap can be provided. However, due to the dispensing switch solely comprising hardware that is not controlled by the control unit the operation of the water tap requires the activation of a switch that is independent of the control unit, which enhances the operational safety of the water tap. As the dispensing switch does not require costly hardware or an operative connection to the control unit, the dispensing switch allows for a cost-effective manufacture of the water tap and also allows for a comfortable as well as safe operation of the water tap. It is possible to allow for a user-dependent reduction of an unlocking time limit that can be individually configured via the control unit.

In an embodiment, the control unit is not operatively connected to the dispensing switch. The control unit can interact with or affect a pump or a valve in order to allow for dispensing water from the water tap which is then initiated by activating the dispensing switch. However, there is no need for an operative connection between the dispensing switch and the control unit in order to provide for a coordinated interaction between the first and second actuating element. Furthermore, the dispensing switch that is not operatively connected to the control unit increases the operative safety in case of any malfunction of the control unit and in particular of the software that runs the control unit.

However, it is possible that the second actuating element or the dispensing switch generates an activation signal that is forwarded or monitored by the control unit. Thus, the operation of the control unit can include information about the current status or a change of the status of the second actuating element or the dispensing switch.

According to an embodiment of the invention, the second actuating element is configured to actuate a timer element that is operatively connected to the dispensing switch. The timer element can be used to activate a valve or a closure element that stops any further outflow of water from the water tap after expiration of a time limit that is preset with the timer element. The timer element can also be used to stop or manipulate any pump that is used to pump water through the water tap. In an example of this embodiment, the timer element is not operatively connected to or controlled by the control unit and thus provides for additional operational safety that is independent of the control unit.

However, it is also possible that the control unit is configured to comprise a timer. The timer can be used in addition to the timer element that is operatively connected to the dispensing switch, providing for a fail-proof cut-off of any outflow of water after expiration of at least one time limit of one of the two timer elements. It is also possible to preset a second time limit for the timer element operatively connected to the dispensing switch that is hard-wired or defined by the hardware of that timer element. However, it is also possible to only use one of the two timer elements.

In yet another embodiment of the invention, the control unit is operatively connected to a further dispensing switch. Such a further dispensing switch can be used to operate a pump or a valve that controls the dispensing of water through the water tap. Even though the further dispensing switch is controlled and operated by the control unit, such a further dispensing switch can be easily integrated into the power supply of a pump to turn the pump on or off, which is used to generate the flow of water through the water tap. Both the dispensing switch and the further dispensing switch may comprise the same hardware components. They can be connected in series within the power supply of the pump or of an electrically operated valve or any other device that is used to control the water flow through the water tap. Thus, only if both dispensing switches are activated at the same time will water be dispensed from the water tap. If only one of the two dispensing switches is not activated properly or becomes deactivated either by a corresponding input of a user or triggered by one of the timer elements, this will prevent any outflow of water through the water tap. Therefore, according to an embodiment of the invention, a pump for dispensing water through the water tap is operatively connected to the dispensing switch and to the further dispensing switch in a manner that the pump is activated only in case that both the dispensing switch and the further dispensing switch are activated.

In an embodiment, one or both of the first actuation element and the second actuation element comprises a touch sensor. A touch sensor allows for a user interaction without need for moving parts like e.g. knobs or buttons. By making use of touch sensors that can be mounted behind a closed surface, e.g. a glass surface or a cover of metal or plastic, there will be no joints or slits between actuation elements that must move with respect to the water tap housing in order to function as actuation element. This avoids additional measurements that are required to provide for a sealing of such movable actuation elements and allows for an easy cleaning of the water tap. Due to the widespread use of touch sensors, such a touch sensor is commercially available at low cost and can be easily operated as a stand-alone actuation element or as additional component that is integrated into the operation of the control unit.

In an embodiment, the control unit comprises a data processing unit that is configured to run a software program that is stored in a program storage unit of the control unit. By modifying the software program that operates the control unit, it is easily possible to adapt some parameters like e.g. a preset time limit of a first timer element or the operation of a pump according to individual or regional preferences, if such modification of parameters is not possible for a user before or after installation of the water tap. In an embodiment, the software program can be updated within the program storage unit in order to provide for enhanced safety measures or additional functions if such additional features become available.

BRIEF DESCRIPTION OF THE DRAWINGS

The present invention will be more fully understood, and further features will become apparent, when reference is made to the following detailed description and the accompanying drawings. The drawings are merely representative and are not intended to limit the scope of the claims. In fact, those of ordinary skill in the art may appreciate upon reading the following specification and viewing the present drawings that various modifications and variations can be made thereto without deviating from the innovative concepts of the invention. Like parts depicted in the drawings are referred to by the same reference numerals.

DETAILED DESCRIPTION OF THE INVENTION

Figure 1:
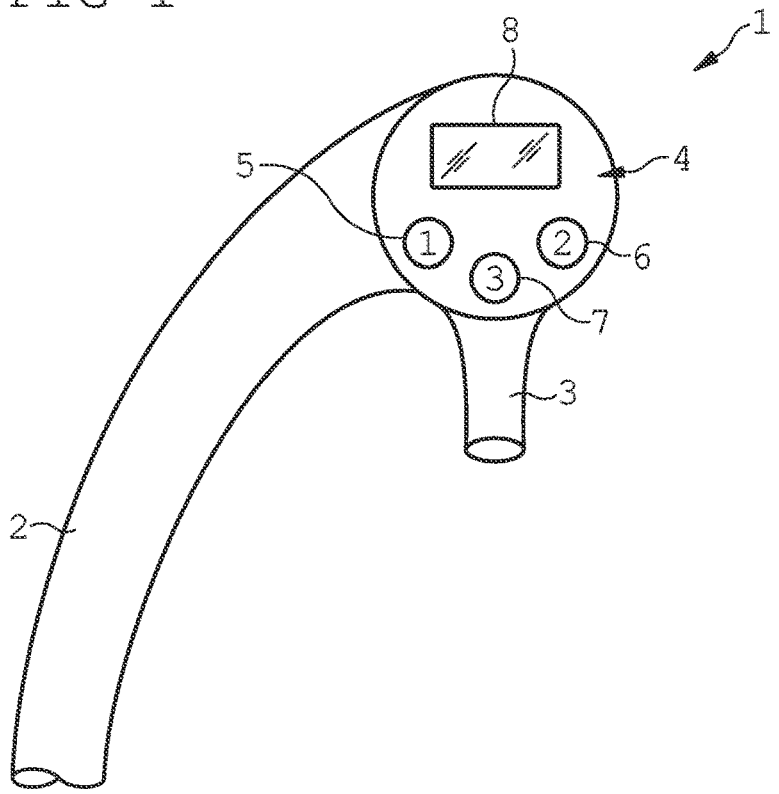
FIG. 1 illustrates a schematic view of a water tap with actuation elements according to the invention.

FIG. 1 shows a water tap 1 as seen by a user. The water tap 1 comprises a supply channel 2 and an outlet 3. Water that is dispensed through the water tap 1 is conveyed through the supply channel 2 and flows out of the outlet 3. The water tap 1 also comprises an operating unit 4. Within the exemplary embodiment that is illustrated in FIG. 1, the operating unit 4 is located near the outlet 3 of the water tap 1. However, the operating unit 4 can also be located far away from the outlet 3 or even not as integral part of the water tap 1, i.e. mounted separately e.g. in a part of a wall, table or a wash basin next to the water tap 1. The operating unit 4 comprises a first actuating element 5, a second actuating element 6 and a third actuating element 7, whereby all actuating elements 5, 6, 7 are designed as touch sensors. The operating unit 4 also comprises a display 8 that can be used to indicate a current status of the operation of the water tap 1 or e.g. the temperature of water that can be dispensed by the water tap 1.

Figure 2:
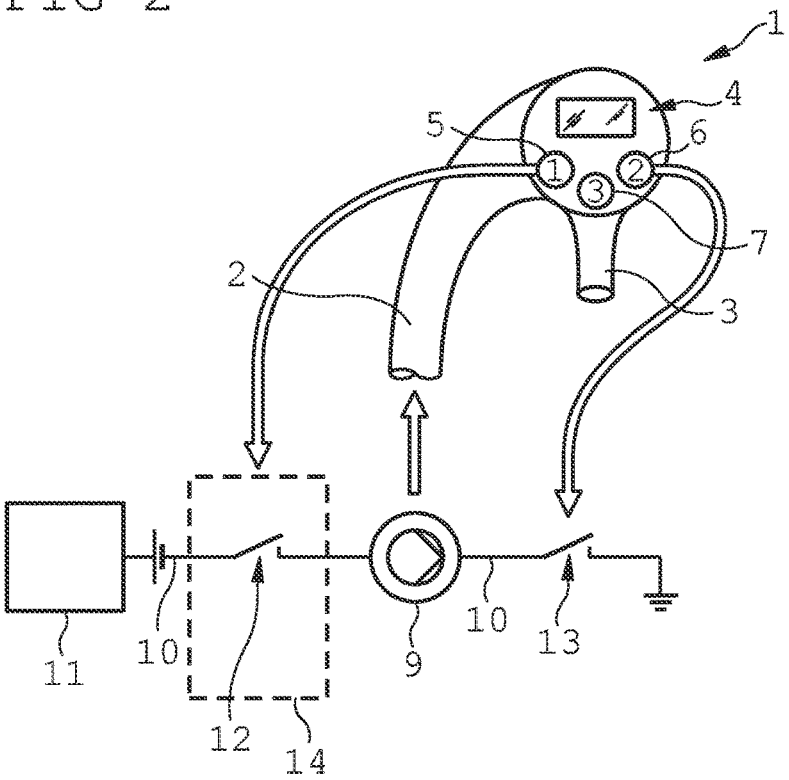
FIG. 2 illustrates a schematic representation of a power supply for a pump that controls the water flow through the water tap, whereby a control unit and a second dispensing switch that is not operatively connected to the control unit control the operation of the pump.

FIG. 2 schematically illustrates a power supply for a pump 9 that controls the water flow through the water tap 1. An electrical line 10 that provides electrical power from a power source 11 to the pump 9 comprises a first dispensing switch 12 and a second dispensing switch 13 that are connected in series within the electrical line 10. The first dispensing switch 12 is controlled and activated by a control unit 14.

The first actuating element 5 is operatively connected to the control unit 14. Any actuation of the first actuating element 5 by a user is monitored by and forwarded to the control unit 14. The control unit 14 then closes the first dispensing switch 12 and starts a unlocking time window. Unless there is no actuation of the second actuating element 6 within the unlocking time window, the first dispensing switch 12 returns to an open state that interrupts the electrical line 10 and any power supply to the pump 9.

The second actuating element 6 is operatively connected to the second dispensing switch 13 in a manner that the actuation of the second actuating element 6 by a user results in an activation of the second dispensing switch 13 that switches between an open and closed state to control the power supply to the pump 9. Neither the second actuating element 6 nor the second dispensing switch 13 are operatively connected to the control unit 14, i.e. these components are not controlled by the control unit 14. However, the control unit 14 can be designed in such a way as to monitor the current status or any change of status of the second actuating element 6 or of the second dispensing switch 13.

As can be seen from the schematic illustration shown in FIG. 2, the pump 9 is only activated and water is only dispensed through the water tap 1 if both, the first dispensing switch 12 and the second dispensing switch 13 are closed and electrical current can flow from the power source 11 through the electrical line 10 to the pump 9 in order to activate and operate the pump 9 to pump water through the water tap 1. Thus, in order to dispense hot water from the water tap 1, a user must first actuate the first actuating element 5. Afterwards, the user must actuate the second actuating element 6 within the unlocking time window. Only then the first dispensing switch 12 and the second dispensing switch 13 are closed and electrical power is transferred from the power source 11 through the electrical line 10 to the pump 9 and hot water is dispensed from the water tap 1.

With the embodiment of the water tap 1 that is illustrated in the figures, a method for operating the water tap 1 can be implemented as follows. Actuation of the first actuating element 5 begins an unlocking step and starts a unlocking time window. The unlocking time window is managed and monitored by the control unit 14. Also, the first dispensing switch 12 is closed. During an activating step, the actuation of the second actuating element 6 activates the second dispensing switch 13. If the second dispensing switch 13 is closed within the unlocking time window, a dispensing step is initiated and water is dispensed through the water tap 1 by activating the pump 9.

If cold water is to be dispensed, a user can actuate the third actuating element 7 that initiates dispensing of cold water through the water tap 1.

In case that the pump 9 is used for dispensing either hot or cold water through the water tap 1, the control unit 14 can be used to operate a valve device or a switch device that operatively connects the pump 9 with a hot or cold water reservoir.

Figure 3:
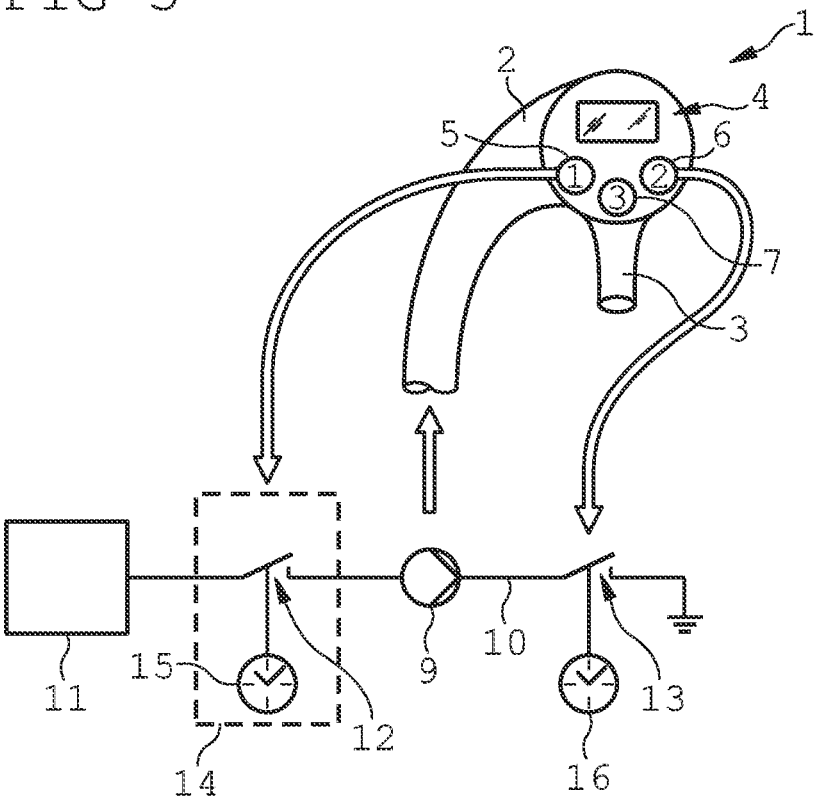
FIG. 3 illustrates a schematic representation similar to FIG. 2, but including a first and second timer element.

According to a further embodiment that is illustrated in FIG. 3, the first dispensing switch 12 is operatively connected to a first timer element 15, and the second dispensing switch 13 is operatively connected to a second timer element 16. Both timer elements 15, 16 can be activated by closing the corresponding first or second dispensing switch 12, 13, and can be used to open the corresponding first or second dispensing switch 12, 13 after expiration of a time limit that is preset for the first and second timer element 15, 16. Thus, even in case there is some malfunction of the control unit 14 or caused by the user, the duration of outflow of water through the water tap 1 is limited. The preset time limit can be e.g. 60 seconds. It is also possible to reduce the time limit of the first timer element 15 that is operatively connected to the control unit 14 at the time of installation of the water tap 1 or via the operating unit 4 at any time during use of the water tap 1.

Figure 4:
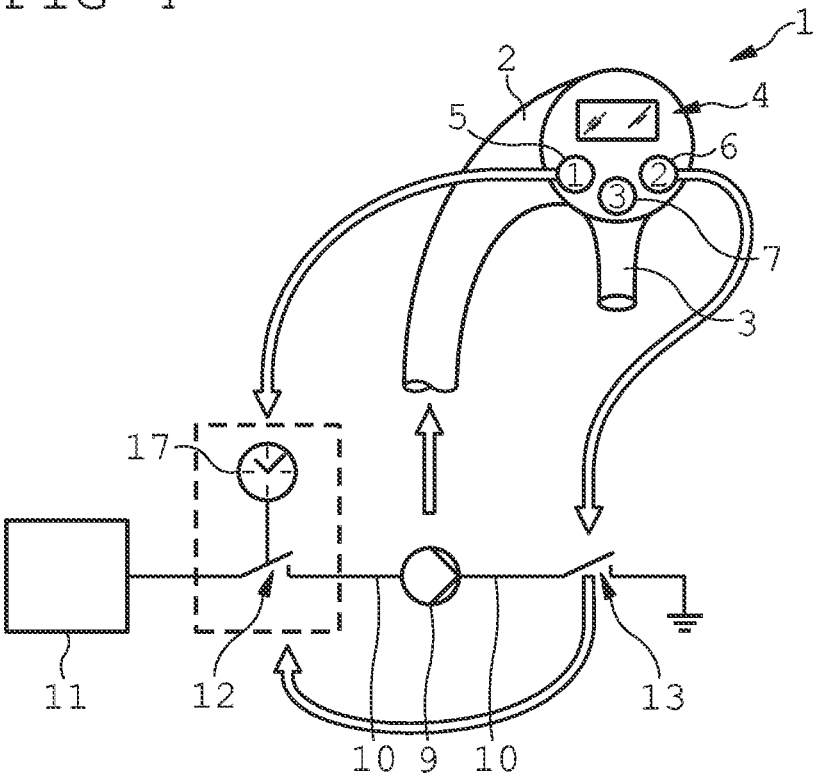
FIG. 4 illustrates a schematic representation of yet another embodiment of the operation of the water tap.

According to yet another embodiment that is illustrated in FIG. 4, the method for operating the water tap 1 differs from the method described with reference to FIG. 2. Within the unlocking step, only the unlocking time window is started and monitored by the control unit 14, but the first dispensing switch 12 is not closed at the same time. After activation of the second dispensing switch 13 an activating signal is forwarded to the control unit 14. Only upon verification that the activating signal is received within the unlocking time window, the control unit 14 closes the first dispensing switch 12 which results in the electrical current flowing through the electrical line 10 and the pump 9 dispensing water from the water tap 1. The unlocking time window can be monitored with a dedicated timer element 17 or e.g. with the first timer element 15.

What is claimed is:

1. A method of operating a water tap, wherein an electric line is part of a power supply of an electric pump or an electric valve for dispensing water through the tap, comprising;

a dispensing step, in which water is dispensed from the water tap, wherein initiation of the dispensing step requires an actuation of a first actuating element and an actuation of a second actuating element, and wherein, in an actuation step, the actuation of the first actuating element is detected by a control unit, wherein the actuation step comprises an unlocking step in which, upon detection of the actuation of the first actuating element, an unlocking time window is started by the control unit, wherein the actuation step also comprises an activating step in which actuation of the second actuating element activates a dispensing switch, wherein the dispensing step is only initiated when the activating step is triggered within the unlocking time window, and wherein closure of the electric line by activating the dispensing switch through actuation of the second actuating element is mandatory to operate the pump or valve and performed in the activating step without involving the control unit.

2. The method according to claim 1, wherein the unlocking step also comprises the activation of a further dispensing switch, and wherein the dispensing step is only initiated when the dispensing switch and the further dispensing switch are activated within the unlocking lime window.

3. The method according to claim 1, wherein the actuation of the second actuating element actuates a timer element that deactivates the dispensing switch after expiration of a preset time limit of the timer element.

4. The method according to claim 1, wherein the control unit starts a timer upon detection of the actuation of the first actuating element or upon starting of the unlocking lime window, and wherein the control unit stops the dispensing step and further dispensing of water from the water tap after expiration of a preset lime limit of the timer.

5. The method according to claim 1, wherein the unlocking step also comprises the activation of a further dispensing switch, and wherein the dispensing step is only initiated when the dispensing switch and the further dispensing switch are activated within the unlocking time window; and wherein the actuation of the second actuating element actuates a timer element that deactivates the dispensing switch after expiration of a preset time limit of the timer element.

6. The method according to claim 5, wherein the control unit starts a timer upon detection of the actuation of the first actuating element or upon starting of the unlocking time window, and wherein the control unit stops the dispensing step and further dispensing of water from the water tap after expiration of a preset time limit of the timer.

7. A system, comprising;

a water tap and operating means comprising a first actuating element, a second actuating element and a control unit, wherein the first actuating element is operatively connected to the control unit, wherein the second actuating element is operatively connected to a dispensing switch, wherein the control unit, is configured to initiate a dispensing step in which water is dispensed from the water tap only after successful verification that an activating signal from the second actuating element is received within an unlocking time window that was started by actuation of the first actuating element, wherein the control unit is operatively connected to a further dispensing switch, and wherein the system further comprises a pump for dispensing water through the water tap, operatively connected to the dispensing switch and to the further dispensing switch whereby the pump is activated only when both dispensing switches are activated.

8. The system according to claim 7, wherein the control unit is not operatively connected to the dispensing switch.

9. The system according to claim 7, wherein the second actuating element is configured to actuate a timer element that is operatively connected to the dispensing switch.

10. The system according to claim 7, wherein the control unit is configured to comprise a timer.

11. The system according to claim 7, wherein one or both of the first actuation element and the second actuation element comprises a touch sensor.

12. The system according to claim 7, wherein the control unit comprises a data processing unit that is configured to run a software program that is stored in a program storage unit of the control unit.

13. The system according to claim 8, wherein the second actuating element is configured to actuate a timer element that is operatively connected to the dispensing switch; and wherein the control unit is configured to comprise a timer.

* * * * *